US011427430B2

(12) United States Patent
Borgelt

(10) Patent No.: US 11,427,430 B2
(45) Date of Patent: Aug. 30, 2022

(54) CORD REEL

(71) Applicant: Leland Borgelt, Spring Hill, KS (US)

(72) Inventor: Leland Borgelt, Spring Hill, KS (US)

( * ) Notice: Subject to any disclaimer, the term of this patent is extended or adjusted under 35 U.S.C. 154(b) by 343 days.

(21) Appl. No.: 16/870,610

(22) Filed: May 8, 2020

(65) Prior Publication Data

US 2021/0347599 A1 Nov. 11, 2021

(51) Int. Cl.
*B65H 75/06* (2006.01)
*B65H 49/20* (2006.01)

(52) U.S. Cl.
CPC ..... *B65H 49/205* (2013.01); *B65H 75/06* (2013.01); *B65H 2701/3915* (2013.01)

(58) Field of Classification Search
CPC .. B65H 75/06; B65H 75/406; B65H 75/4476; B65H 2701/3915; B65H 2402/412; B65H 49/205
See application file for complete search history.

(56) References Cited

U.S. PATENT DOCUMENTS 3,885,752 A * 5/1975 Noffsinger ..... B65H 75/406 242/395
4,022,398 A * 5/1977 Youngblood ..... B65H 75/406 242/395
4,501,563 A * 2/1985 Johnson ..... B63C 7/26 441/6
2004/0065765 A1* 4/2004 Fleming ..... B65H 75/406 242/405

* cited by examiner

*Primary Examiner* — Sang K Kim

(74) *Attorney, Agent, or Firm* — Invention Protection Associates, LLC

(57) ABSTRACT

A handheld reel device for collecting and releasing string lights and that accommodates use of handles of variable lengths for manually rotating the reel.

7 Claims, 2 Drawing Sheets

CORD REEL

BACKGROUND

The present invention generally relates to handheld reel devices about which string lights (e.g., Christmas tree lights) can be manually wound for storage and unwound for deployment (e.g., draped around a Christmas tree), and it is specifically directed to such a reel that features removable winding handles so that substitute handles of a variety of lengths can be employed as may be needed to spool and unspool lights at any range of height positions (e.g., around the upper reaches of an exceedingly tall Christmas tree).

Traditionally, most American households erect Christmas trees and decorate them with a variety of ornaments and string lights during the Winter. Because these string lights can easily become tangled during the process of removing them from trees and during their subsequent storage, a host of handheld reel devices have been developed in the prior art. These devices are designed to allow light to be orderly coiled around them for storage, rather than being balled up into an unwieldy, tangled mess. Nevertheless, as will be explained, the present inventor has recognized a common deficiency of virtually all these prior art reel devices.

In many instances, adorning a Christmas tree with string lights is a considerably easier task than is later removing those same lights from the tree. That is because, while string lights can be flung onto the tree branches (real or synthetic) to rest along the tree in a generally upwardly spiraling fashion, it takes a bit more care and diligence to remove them from their resting places along the tree limbs and unwrap them from the tree. In fact, portions of the string that are at limb elevations higher than the upward reach of the lights removing person's arms are at risk of damaging limbs (severing pine needles at the very least) or even causing the tree to topple due to the downward force that is likely to be applied to those limbs during the attempts to pull the string down from those higher elevation limbs. Of course, the taller the tree and/or lower the reach of the lights removing person, the more pronounced this issue can be. Accordingly, that tree height/remover reach relationship can make uninstalling string lights from a Christmas tree a very tedious, physically taxing task to perform with the requisite degree of finesse. In fact, one may need to use a ladder—and continually reposition it at various points around the perimeter of the tree—in order to successfully and safely unwrap a string of lights from the tree. One may also need to use a ladder, in similar fashion, to install string lights at higher tree elevations, because tossing them upward onto a tree may produce disorderly looking results.

Consequently, the present inventor has recognized a need for a new, handheld reel for string lights and other cords that is unique in that its handle components used for gripping when winding and unwinding string lights therefrom are easily removable and substitutable with handles of widely varying lengths (or are, themselves, length adjustable). This enables the present invention to be used in comfortably and neatly installing and uninstalling string lights along vertical positions that are well above a user's arm reach without the aid of a ladder. The present invention fulfills that recognized need.

SUMMARY

It is an object of the present invention to provide a handheld reel for string lights and other cords that can be variable with respect to the perpendicular distance between its central plane of coiling and where a user's hands are placed in order to manually impart string light coiling and uncoiling rotation.

In one aspect of the inventive reel apparatus, it features a pair of longitudinal extending members, akin to rigid ladder's rails, and a pair of laterally extending attachments that connect those members in spaced relation and are akin to a ladder's rungs. In fact, the lateral attachments serve as rods about which string lights are to be spooled, and the longitudinal members serve the dual purposes of (i) providing outer barriers that prevent the spooled string lighting from sliding laterally off of the rods and (ii) anchoring, at times, two laterally extending handles, and at other times, one such handle that enable a user to manually rotate the apparatus in its string lights coiling and uncoiling motions, respectively. More specifically concerning that latter purpose, unlike as is the case with prior art reel devices made for spooling string lights, the handle elements of the present apparatus are not permanently attached to the apparatus (be it at fixed axes or pivotable between alternative axes). Rather, they are insertable into and rotatable within holes, or "ports," formed in the longitudinal extending members at different positions which enable manual rotation in clockwise and counterclockwise directions. This allows different handles of different lengths to be employed—which, in turn, enables a user that is utilizing lengthy handles to rotate the apparatus while the central plane of coiling is oriented horizontally and is raised vertically above his arms' upward reach. Consequently, the present device enables a user to release string lighting from the reel so that it neatly deposits along a desired path at high positions along a tall Christmas tree, rather than haphazardly flinging the string lights up onto the tree or having to use a ladder that must be continually repositioned around the tree perimeter.

In another aspect of the invention, the handle elements may be of variable length, not only by virtue of detachable handles of differing lengths being able to be alternatively used, but by virtue of individual handles being, themselves, length adjustable. For example, each handle may be formed by a pair of telescopically engaged tubular pieces, where the inner tubular piece features a spring-loaded, radially outwardly biased pin, and the outer tubular piece has a plurality of pin receiving holes, formed along its length, that allow the two pieces to be locked into place at different positions to render different composite handle lengths. Other structural configurations that allow for length adjustment of the handles are within the scope of the invention as well.

DETAILED DESCRIPTION OF THE PREFERRED EMBODIMENTS

Figure 1:
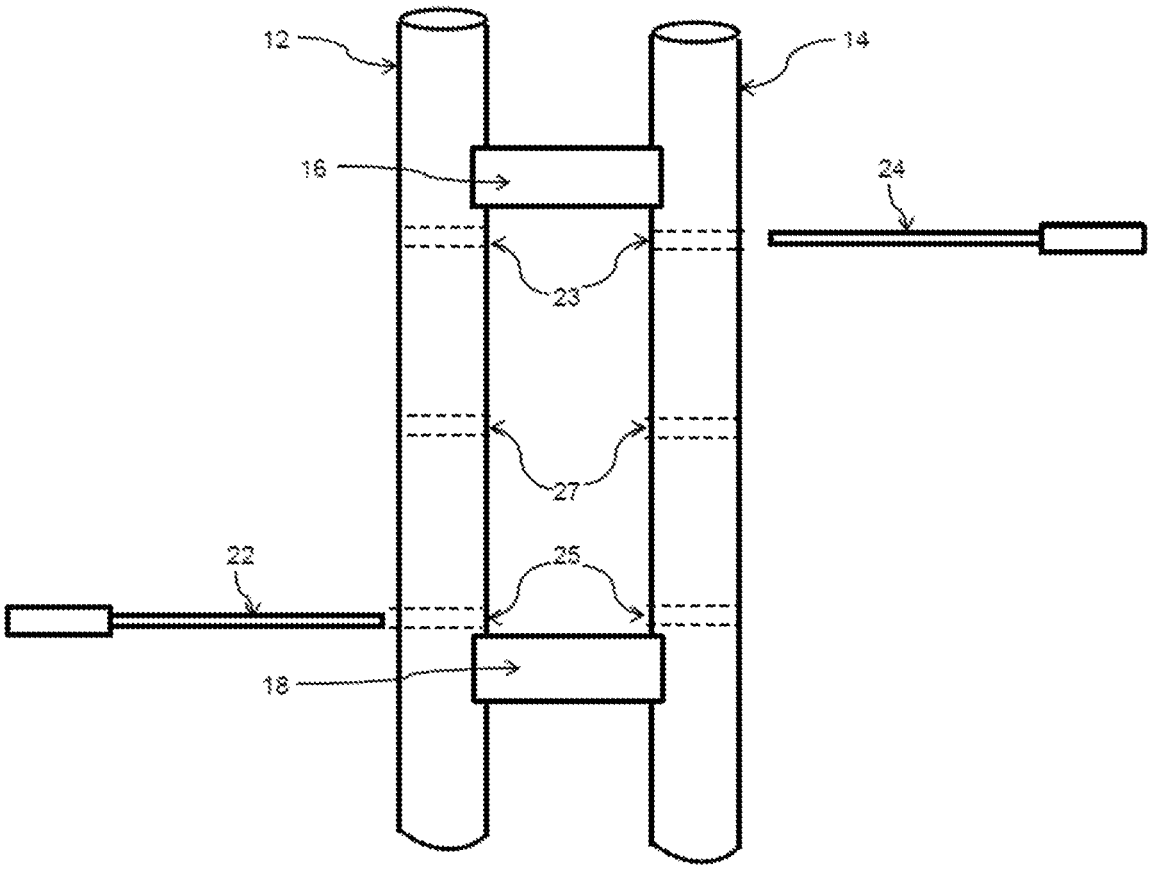
FIG. 1 is an elevational view of the cord reel apparatus in accordance with the present invention, the apparatus shown with two handle elements disengaged from port positions that they would be inserted into for string lights winding up rotation of the apparatus.

This disclosure, as defined by the claims that follow, relates to a reel device that allows string lights and other cord-like objects (hereinafter, to all be broadly referred to as simply "string lights") to be coiled around and collected onto it by way of manually rotating the device in one direction and uncoiled and removed from it by rotating the device in the opposite direction. In its simplest form, the present device is defined by a pair of longitudinally extending members that feature port holes for removably inserting handles into and that are laterally spaced apart by a pair of laterally extending attachments that are longitudinally spaced from each other and that are each connected to the longitudinally extending members. The port holes are positioned such that when two handles are properly inserted toward the respective longitudinal ends of the device, a user holds them to rotate to the device in a way that coils string lights onto the device, and when one handle is inserted at the longitudinal center of the device, the user holds that handle to allow the device to oppositely rotate and uncoil string lights from it (and onto a Christmas tree, for example).

The "longitudinal extending members" can take on a variety of alternative configurations such as being rod-like, rail-like, or plate-like. Nevertheless, one of the longitudinal members will, hereinafter, be referred to as the left longitudinal member 12, and it has formed through it a proximal hole 23 and a distal hole 25. A central hole 27 resides at its longitudinal center. Each such hole 23, 25, 27 is, in fact, two axially aligned holes formed in the laterally inner and outer walls of the longitudinal member 12 if it has a hollow structure. Nevertheless, because these holes may have closed ends, they will, hereinafter, be referred to as "ports".

The other longitudinal member 14 has a similar arrangement of ports 23, 25, 27, and it is held in parallel with its counterpart member 12 by a pair of "lateral extending attachments" which are, preferably, pipe-like or at least have rounded outer surfaces. One such lateral attachment 16 is attached to the longitudinal members 12, 14 toward their respective proximal ends and adjacent their proximal ports 23, while the other lateral attachment 18 is attached toward the longitudinal members' distal ends and adjacent their distal ports 25.

Handles are insertable into all of the ports and are rotatable relative to the longitudinal members 12, 14. So, when, as can be gleaned from viewing FIG. 1, a first handle 22 is inserted into the distal port 25 of member 12 (and may extend into the counterpart port 25 of member 14) and a second handle 24 is inserted into the proximal port 23 of member 14 (and may extend into the counterpart port 23 of member 12), a user can hold each handle and perform an arm pedaling motion to rotate the longitudinal members 12, 14 about their central axes and cause string lights to gather in a coil around the lateral attachments 16, 18.

Figure 2:
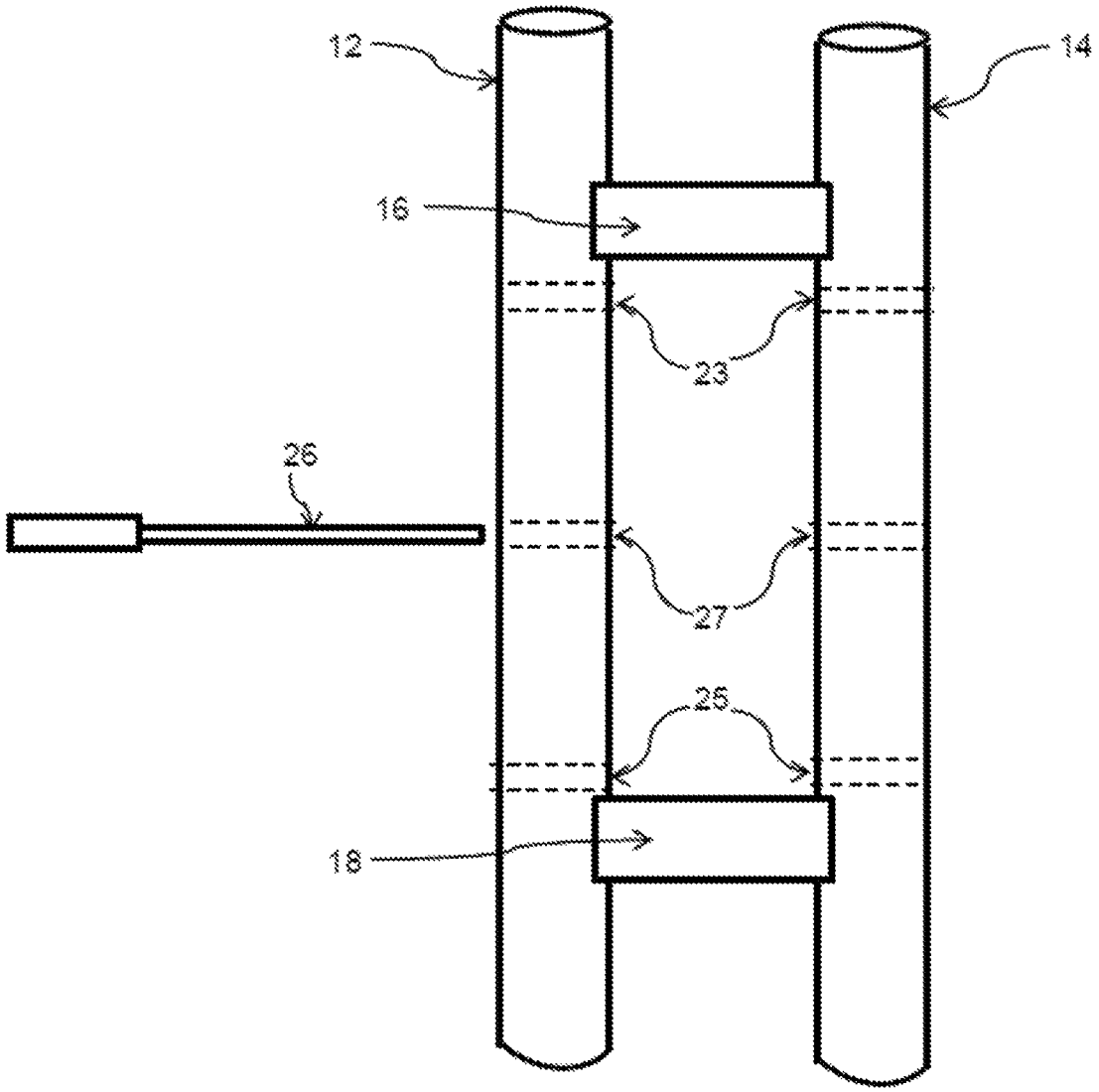
FIG. 2 is elevational view of the same, the apparatus shown with one handle element disengaged from a port position that it would be inserted into for string lights unwinding rotation of the apparatus.

Then, as can be gleaned from viewing FIG. 2, a single handle 26 is inserted into central hole 27 of either longitudinal member so that that the reel can freely spin in an opposite direction of rotation about its central axis while string lights uncoil off of it.

Finally, it is contemplated that a variety of objects can be employed as handles. For example, screwdrivers could be used. Considerably longer objects could be used as well. Furthermore, each handle may, itself, be variable in length. For example, a handle can be formed by telescopically engaged parts that can be repositioned into different aggregate lengths. Alternatively, the handles could be made of components that are end-to-end attachable to adjust their composite length.

What is claimed is:

1. A cord reel for winding string lights and cords about, the reel comprising:

a pair of longitudinal extending members that are laterally spaced and disposed in parallel, wherein each said extending member has a first end and an opposing second end;

a first lateral extending attachment that extends between the longitudinal extending members and attaches thereto substantially proximate their respective first ends;

a second lateral extending attachment that is longitudinally spaced from said first lateral extending attachment, extends between the longitudinal extending members, and attaches thereto substantially proximate their respective second ends;

wherein formed along one of said longitudinal extending members is a first port for receiving a handle element, such that the handle element is rotatable relative thereto and removable therefrom, substantially proximate the longitudinal position of the first lateral extending attachment; and wherein formed along the other longitudinal extending member are:

a second port for receiving a handle element, such that the handle element is rotatable relative thereto and removable therefrom, substantially proximate the longitudinal position of the second lateral extending attachment; and a third port for receiving a handle element, such that the handle element is rotatable relative thereto and removable therefrom, substantially at the longitudinal center of one of said longitudinal extending members.

2. The cord reel of claim 1, wherein said longitudinal extending members are tubular structures, and wherein each of said ports is formed by axially aligned holes formed through laterally inner and outer walls of said tubular structures.

3. A cord reel for winding string lights and cords about, the reel comprising:

a pair of longitudinal extending members that are laterally spaced and disposed in parallel, wherein each said extending member has a first end and an opposing second end;

a first lateral extending attachment that extends between the longitudinal extending members and attaches thereto substantially proximate their respective first ends;

a second lateral extending attachment that is longitudinally spaced from said first lateral extending attachment, extends between the longitudinal extending members, and attaches thereto substantially proximate their respective second ends;

at least two handle elements adapted to be removably attached to and extend laterally outward of longitudinal extending members;

wherein formed along one of said longitudinal extending members is a first port for receiving a handle element, such that the handle element is rotatable relative thereto and removable therefrom, substantially proximate the longitudinal position of the first lateral extending attachment; and wherein formed along the other longitudinal extending member are:

a second port for receiving a handle element, such that the handle element is rotatable relative thereto and removable therefrom, substantially proximate the longitudinal position of the second lateral extending attachment; and a third port for receiving a handle element, such that the handle element is rotatable relative thereto and removable therefrom, substantially at the longitudinal center of one of said longitudinal extending members.

4. The cord reel of claim 3, wherein said handle elements are length extendable.

5. The cord reel of claim 4, wherein said handle element length is telescopically extendable.

6. The cord reel of claim 4, wherein said handle elements are adapted to have length-extending attachments attached thereto.

7. The cord reel of claim 3, wherein said longitudinal extending members are tubular structures, and wherein each of said ports is formed by axially aligned holes formed through laterally inner and outer walls of one of said tubular structures.

* * * * *